US005153541A

United States Patent [19]

Johnson et al.

[11] Patent Number: 5,153,541

[45] Date of Patent: Oct. 6, 1992

[54] FOLDED INTERDIGITAL NOTCH FILTER

[75] Inventors: Arlen K. Johnson, New Providence; Peter S. Rha, Bridgewater; Gary D. Stuck, Randolph, all of N.J.

[73] Assignee: AT&T Bell Laboratories, Murray Hill, N.J.

[21] Appl. No.: 703,323

[22] Filed: May 20, 1991

[51] Int. Cl.[5] ..... H01P 1/205

[52] U.S. Cl. ..... 333/203; 333/209

[58] Field of Search ..... 333/202, 203, 206, 207, 333/208, 209, 212, 134, 227, 230-232, 235

[56] References Cited

U.S. PATENT DOCUMENTS

| | | | |
|---|---|---|---|
| 3,597,709 | 8/1971 | Rhodes | 333/203 |
| 3,737,816 | 6/1973 | Honicke | 333/212 |
| 3,818,389 | 6/1974 | Fisher | 333/203 |
| 4,596,969 | 6/1986 | Jachowski | 333/203 |
| 5,008,956 | 4/1991 | Hemmie | 333/203 X |
| 5,023,579 | 6/1991 | Bentivenga et al. | 333/203 |

FOREIGN PATENT DOCUMENTS

| | | | |
|---|---|---|---|
| 0101369 | 2/1984 | European Pat. Off. | 333/212 |

OTHER PUBLICATIONS

"High-Frequency Plane-Wave Filter Function for a Folded Path" by J. Smith et al., Journal of the Optical Society of America vol. 62, No. 10, Oct. 1972, pp. 1183-1187.

"Circulator Improves Notch Filter Selectivity", by G. Thomas RF Design, Nov. 1988, pp. 72-74.

"A Compact Channel-Dropping Filter for Stripline and Microwave Intergrated Circuits" by E. G. Cristal and U. H. Gysel, IEEE Transactions on Microwave Theory and Techniques, May 1974 pp. 499-504.

"New Design of Electromechanical Filters at 128 KHZ" by M. Bon R. Bosc and P. Lovez IEEE International Symposium on Circuits and Systems, Apr. 1975, pp. 239-242.

"Linear Phase Decimation and Interpolation Filters for High-Speed Applications" by E. DeMan and U. Kleine, Electronic Letters, Jun. 9, 1988, vol. 24, No. 12, pp. 757-759.

"Folded-Line and Hybrid Folded-Line Bandstop Filters", by P. A. Dupuis and E. G. Cristal, IEEE Transaction on Microwave Theory and Techniques, Dec. 1974, pp. 1312-1316.

"Mixed Mode Filters" by D. A. Taggart and R. D. Wanselow IEEE Transactions on Microwave Theory and Techniques Oct. 1974, pp. 898-902.

"Interdigital Band-Pass Filters", by G. L. Matthaei IRE Transactions on Microwave Theory and Techniques Nov. 1962, pp. 479-491.

*Primary Examiner*—Eugene R. LaRoche
*Assistant Examiner*—Seung Ham
*Attorney, Agent, or Firm*—A. G. Steinmetz

[57] ABSTRACT

An interdigital resonant cavity filter structure is foled to provide two adjacent chambers physically positioned side by side and electrically connected in series with each other. A center plate divides the two chambers with a slot at one end of the structure to permit the two chambers to function as one resonant cavity in a folded relation to each other. Each chamber includes interdigital resonators which are related to the overall resonant cavity to produce a band pass filter action within the folded resonant cavity. The input of the filter structure is applied through a port of a circulator connected to one end of the resonant cavity and the output is taken from another port of the circulator. The opposite end of the resonant cavity is terminated in the characteristic impedance of the resonant cavity thereby causing the overall structure to operate as a high quality notch filter.

17 Claims, 13 Drawing Sheets

FOLDED INTERDIGITAL NOTCH FILTER

FIELD OF THE INVENTION

This invention relates to high frequency filter circuits and, in particular, to a coupled line filter structure and specifically an interdigital notch filter apparatus.

BACKGROUND OF THE INVENTION

At high frequencies, resonant circuits such as filter circuits, use distributed components in place of the discrete lumped circuit components used at lower frequencies. Hence, distributed component filter circuitry is used in microwave radio circuits as the band pass and band reject filters in the various stages of the radio circuitry. These filters are typically required, depending on their immediate application, to meet certain size, weight and performance constraints.

Coupled line filter structures having interdigital or comb line structures are frequently used for these applications. These filters include a series of resonant elements arranged in a comb like pattern in an air chamber. These resonant elements are tuned so that the coupled line exhibits some desired frequency characteristic such as frequency band pass. They are easy to manufacture since they do not demand tight tolerances, however for many applications their size and weight may be too great and/or their electrical characteristics such as Q (quality) may not provide the desired electrical performance.

For a given frequency and performance response, a standard resonant cavity filter may have a size exceeding permissible dimensions required by the circuitry package for the intended application. It may have electrical performance requirements that require a high Q value not attainable in the structure under consideration.

SUMMARY OF THE INVENTION

A coupled line filter structure embodying the principles of the invention is folded to provide two series connected air chambers located side by side and in parallel with each other. Each chamber includes interdigitized resonators. A center plate divides the two chambers with a slot at one end to permit the two chambers to function as one resonant cavity. In accord with the invention, the slot is tunable for adjusting electrical coupling between the chambers.

In a particular embodiment shown herein, each chamber includes interdigital resonators that are tuned to enable the folded resonant cavity to produce a band pass filter action. The input to the folded resonant cavity is applied to one chamber through a circulator and the output of the second chamber is terminated in the characteristic impedance of the coupled line or resonant cavity. Output of the filter is through the circulator thereby causing the overall structure to operate as a high quality notch filter.

DETAILED DESCRIPTION

Cellular radiotelephone communications are based on a cell division scheme having specific communication frequencies assigned to specific cells with each cell serving a specific geographical area. The communications are handled through a cell site within the cell having the necessary radiating and receiving antennas and related transmitting and receiving equipment. Often the complete coverage of the cell or geographical area from the cell site is inadequate. In some instances the cell site antenna does not properly radiate the total area of the cell leaving dead areas in which the service to radiotelephones is substandard or non-existent. Splitting the cell into smaller cell areas to improve service is often not desirable due to a lack of suitable cell site locations and/or the expense of providing many new cell sites with its extensive and expensive equipment. One solution to this dilemma is to provide satellite or remote signal radiator and signal receivers at specific locations within the cell where there is poor radio transmission and reception to and from the cell site. These satellite or remote transceivers are connected by land lines to the central cell site and are operative to radiate and receive radio signals. This improves the signal coverage in areas where the cell site radiation and reception is substandard.

Figure 1:
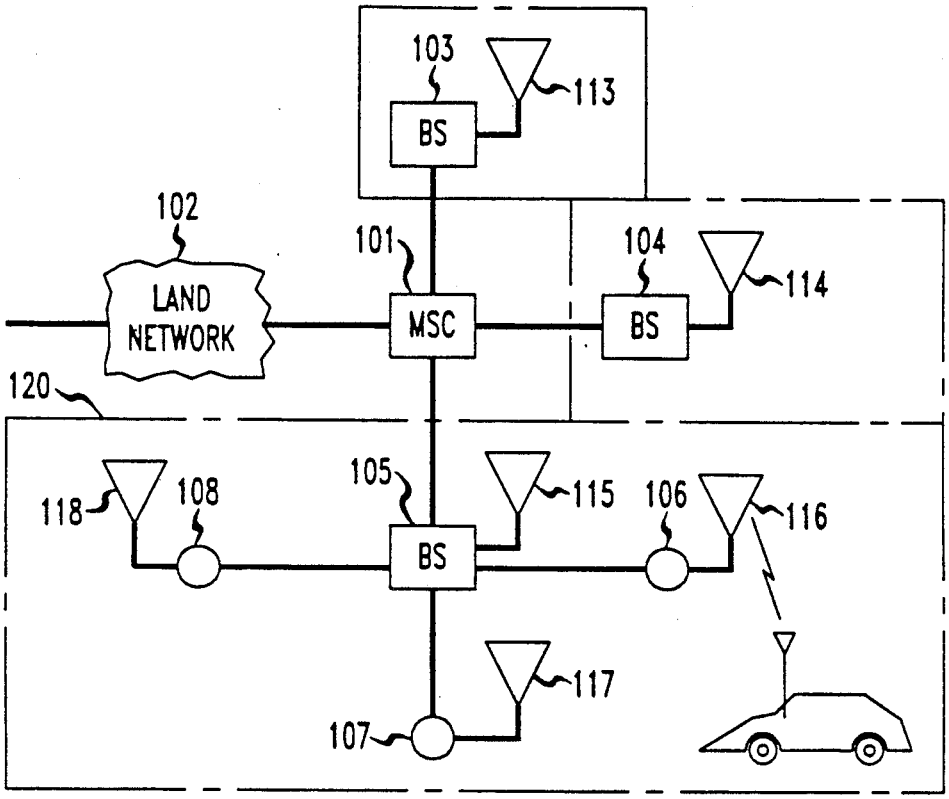
FIG. 1 is a block diagram of a cellular radio communication system.

A cellular telephone system including remote transceivers (e.g. radiators and receivers) is shown in the FIG. 1. A mobile switching center 101 interconnects a land telephone system 102 to the various base sites 103, 104 and 105. Each of the base sites includes radio equipment connected to communicate to the mobile radiotelephones and each has a cell site antenna 113, 114 and 115, respectively, to transmit and receive radio signals. It also includes the necessary stored program controls to control channel assignments, handoffs and registrations. The base site 105 does not properly radiate all of its intended area to provide the desired service level and, hence, various locations of its cell 120 are poorly radiated. Remote transceiver stations 106, 107 and 108, each having an antenna 116, 117 and 118 respectively, have been installed at various locations within the cell 120 to radiate these otherwise poorly radiated locations of the cell. These stations, connected to the mobile switching control 101 by land lines, are all located within the cell in order to provide substantially uniform illumination of the cell. Each remote transceiver station includes transmission and switching equipment to couple it to the base site 105 which has all the stored program controls of the cell.

Figure 2:
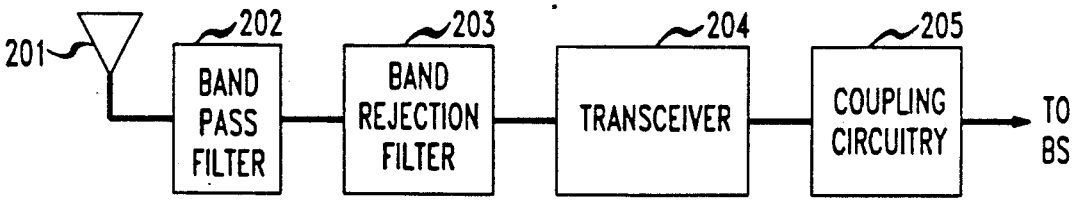
FIG. 2 is a block diagram of a remote transmitter/-receiver of the cellular radio communication system.
Figure 3:
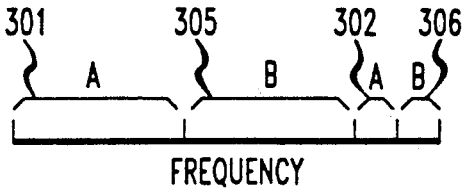
FIG. 3 is a graph of a frequency allocation of the radio communication system.
Figure 4:
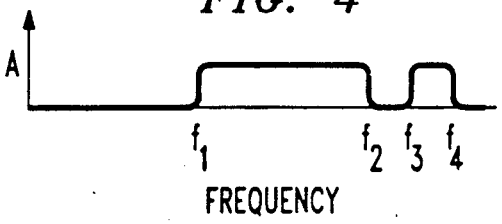
FIG. 4 is a graph of a frequency spectrum of a radio communication system.

Each remote transceiver station includes the necessary circuitry for providing line communication between the satellite station and the cell site. Since the remote transceiver station is designed to eliminate the expense of cell splitting into a plurality of cells it is of necessity small and light in weight so it may be mounted on external building walls, inside buildings and other similar mounting locations to obviate the need for new cell sites. A block diagram of a portion of the processing circuitry of a remote transceiver station is shown in FIG. 2. A transmitting and receiving antenna 201 is connected to a band pass filter 202. The bandpass filter 202 is connected to a band rejection filter 203. It in turn is connected to transceiver equipment 204 to process received signals and signals intended for transmission. A cellular frequency allocation, in which the cell site and its remote transceiver stations operate, is shown in the graph of FIG. 3. The frequencies assigned to system A includes the portions 301 and 302 of the spectrum. The frequencies assigned to system B includes the portions 305 and 306 of the spectrum. Each system has a discontinuous assigned frequency spectrum and, hence, has a band with a portion of frequencies that must be blocked out. This blocking is performed with a band rejection filter. The allowable spectrum for system B, for example is shown by the waveform of FIG. 4. As is shown, the frequencies from $f_1$ to $f_2$ and from $f_3$ to $f_4$ are permissible and the frequencies from $f_2$ to $f_3$ are interference and must be blocked. The blocking of these frequencies is performed by a band rejection filter also called a notch filter. At the radio frequencies used for radiotelephone service, coupled line filters with distributed components are used in the remote station equipment. Their use, however, is limited by the size and weight of a coupled line air chamber filter needed to meet the quality requirements of a notch filter for blocking the non-allowable (ie interfering) band of frequencies and the size and weight constraints of the remote transceiver station.

Figure 5:
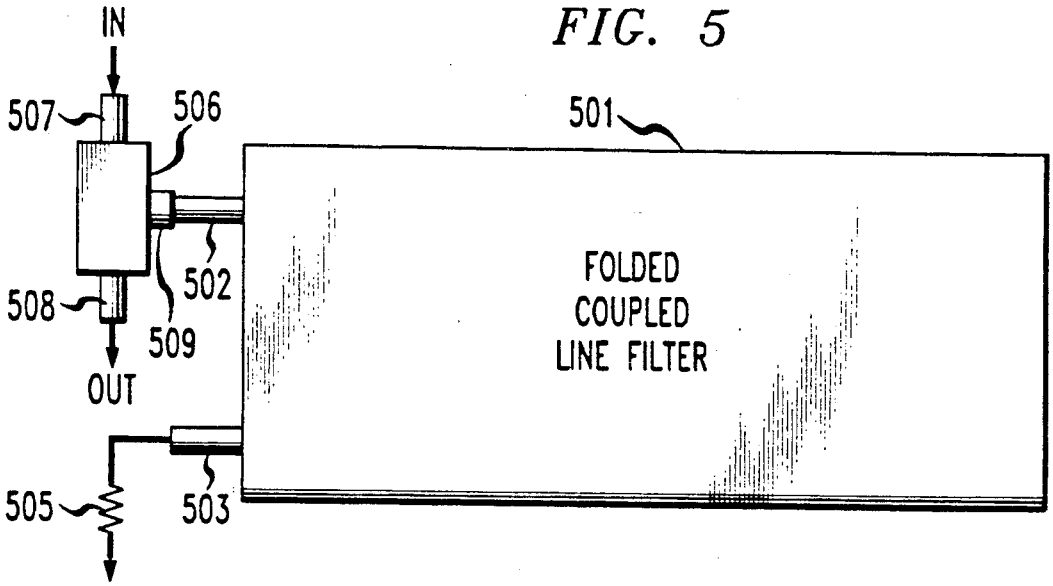
FIG. 5 is a block schematic of a coupled line filter structure used in the remote transmitter/receiver of FIG. 2.

A coupled line notch filter, suitable for this application, is shown in the block schematic of FIG. 5. The block 501 depicts a folded coupled line interdigital filter device with a folded air chamber serving as a resonant cavity. Two coaxial connectors 502 and 503 electrically couple the electrical signals of the cavity to the external circuitry outside of the cavity. A grounded terminating impedance 505 with an impedance value equaling the characteristic impedance of the cavity resonator is connected to the connector 503. A circulator device 506 has its central port 509 connected to the connector 502. The circulator device also includes an input port 507 and an output port 508. The circulator device 506 is a radio frequency unidirectional signal transmission device and is operative to unidirectionally permute power signals from one port to the next port of the circulator device. Input signals having a broad band of frequency extending from $f_1$ to $f_4$, with the frequencies from $f_2$ to $f_3$, to be rejected are applied to the input port 507 and are circulated to the central port 509 where they are input, via the coaxial connector 502, to the chamber of the coupled line filter, 501. The coupled line filter operates as a band pass filter transmitting the signal frequencies between $f_2$ to $f_3$ to the terminating impedance 505. All other frequency signals are reflected back to the port 509 of the circulator device 506 and these signals exclusive of the band from $f_2$ to $f_3$ are permuted to the output port 508. This particular arrangement produces a notch filter having an operative quality Q significantly higher than that of the coupled line band pass filter.

Figure 6:
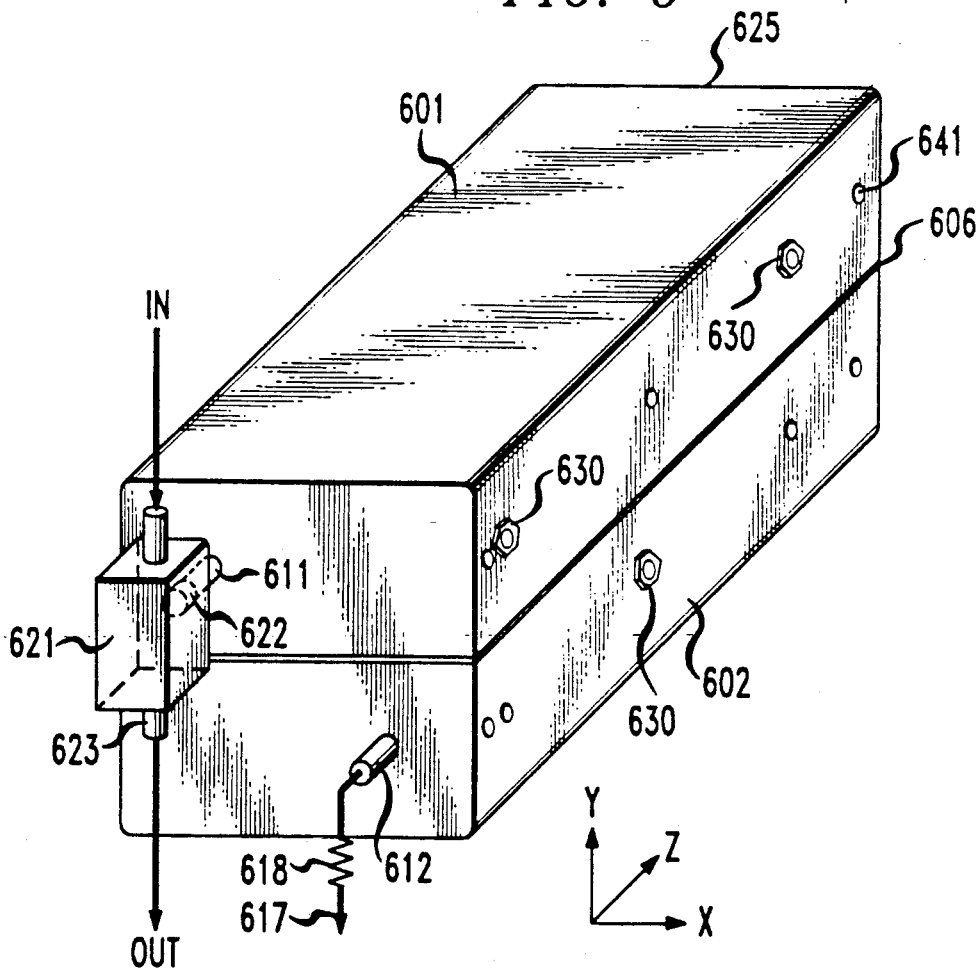
FIG. 6 is a pictorial view of a coupled line filter embodying the principles of the invention.

The overall filter apparatus is shown in pictorial form in the FIG. 6. Two conductive members 601 and 602 having substantially a channel shape are joined to a central or common planar member 606 (substantially internal to the apparatus) which divides the apparatus into substantially two chambers. In a preferred arrangement, these components are joined by welding at the junction located along the two longitudinal edges of the channel of the conductive channel shaped members 601 and 602 and the common planar member 606.

Coaxial connectors 611 and 612 are connected to and penetrate an endplate 609 joined to the near end of the chambers of the apparatus. The coaxial connector 612 is connected to a ground 617 through an impedance device 618 having an impedance value equaling the characteristic impedance of the coupled line structure cavity. A wave signal circulator device 621 is connected to the coaxial connector 611. This device has its central port 622 connected to the coaxial connector 611. It has an input port 621 and an output port 623.

An endplate 625 (not shown) closes the other end of the chamber. The common planar conductor, separating the two internal chambers, terminates short of reaching the end plate 625 to form a slot to allow signal energy to pass from one chamber to another chamber. This produces a folding of the resonant cavity and allows signal energy to be applied as an input to the coaxial connector 611 and to be output at the coaxial connector 612. Each individual chamber includes resonator rods mounted horizontally and interdigitally in each chamber. Tuning screws 630 are positioned opposite the free ends of the resonator rods to permit individual tuning of these resonator rods. Tuning screws 641 are also provided to electrically tune the slot.

Figure 7:
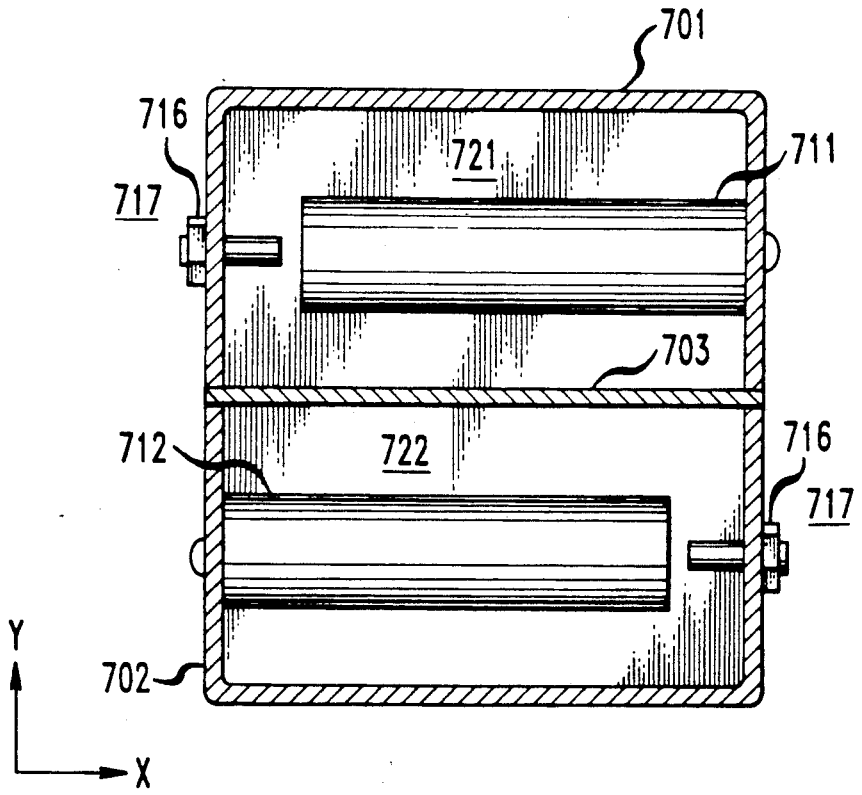
FIGS. 7–18 are cross sectional and orthographic projection views of the coupled line filter of FIG. 6 and its component piece parts.

A vertical cross section (x-y plane) of the two chambers is shown in FIG. 7. The channel shaped conductive members 701 and 702 are each connected to the common planar conductor 703 by welding or other fastening means. The channel sections 701 and 702 are each substantially rectangular in cross section and with the common planar conductor 703 form the two chambers 721 and 722. Each chamber 721 and 722 includes resonator rods 711 and 712 affixed to one sidewall of the channel member and having their longitudinal axis in the x axis direction (FIG. 6). Opposite the free end of each resonator rod is a tuning screw 717 threaded through a side well and secured in place with a nut 716 threaded onto the body of the screw.

Figure 8:
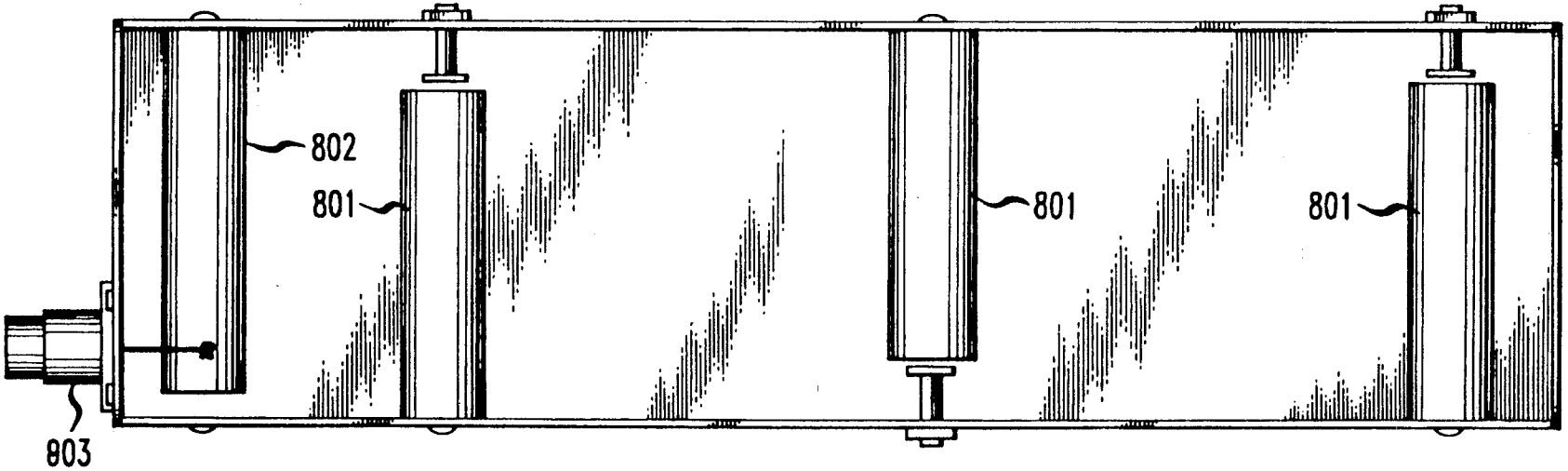

A cross sectional view (x-z plane) of one of the two chambers is shown in FIG. 8. This chamber includes a plurality of interdigital resonators 801. The cavity also includes a transformer rod 802 connected to a coaxial connector 803. The use of a transformer rod may provide superior impedance matching in the connection of the resonant cavity to the coaxial connectors 803. The transformer rods 802 may be different in longitudinal dimension from the adjacent resonator rods 801. It is to be understood that the coaxial connectors 803 may be directly connected to an end resonator rod with proper care given to the location of the coaxial connector contact point addressing the adjacent resonator rod. A resonator rod in this connection arrangement has the same dimensions as the remaining resonator rods 801 in the chamber.

Figure 9:
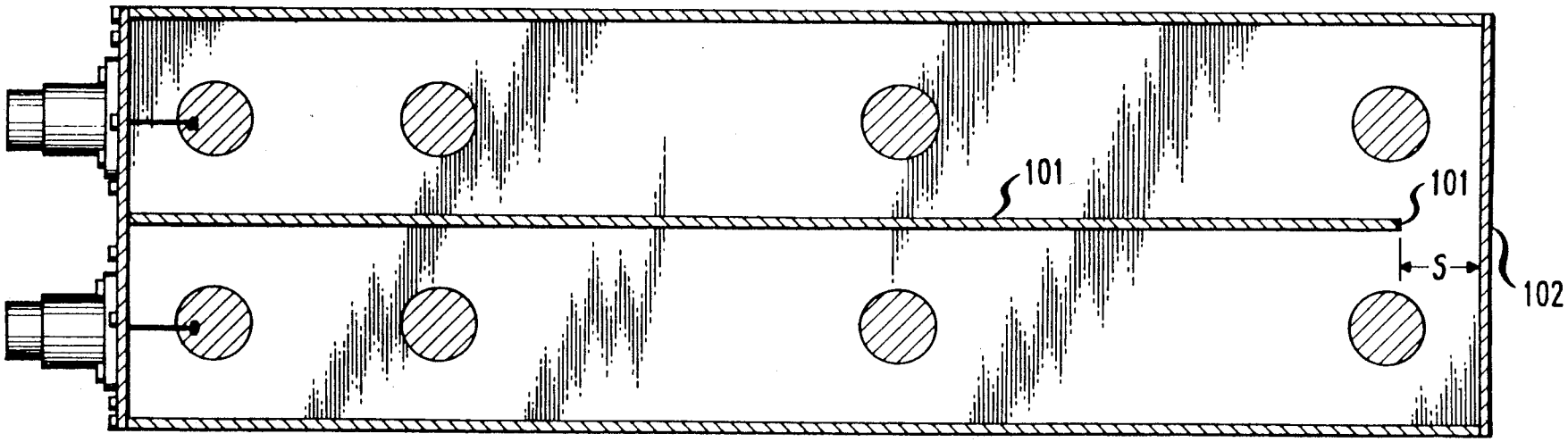

A schematic cross sectional view (y-z plane) of the resonator cavity is shown in FIG. 9. The common planar conductor 101 has a shorter longitudinal dimension than the channel shaped conductive members forming the outside wall of the cavities. The slot (shown by dimension S) between the end 101A of the planar conductor 101 and the endplate 102 allows the signal energy to flow from one chamber to the other or fold about so that the length of the combined resonant or folded resonant cavity is substantially twice the length of the two chambers of the apparatus.

Figure 10:
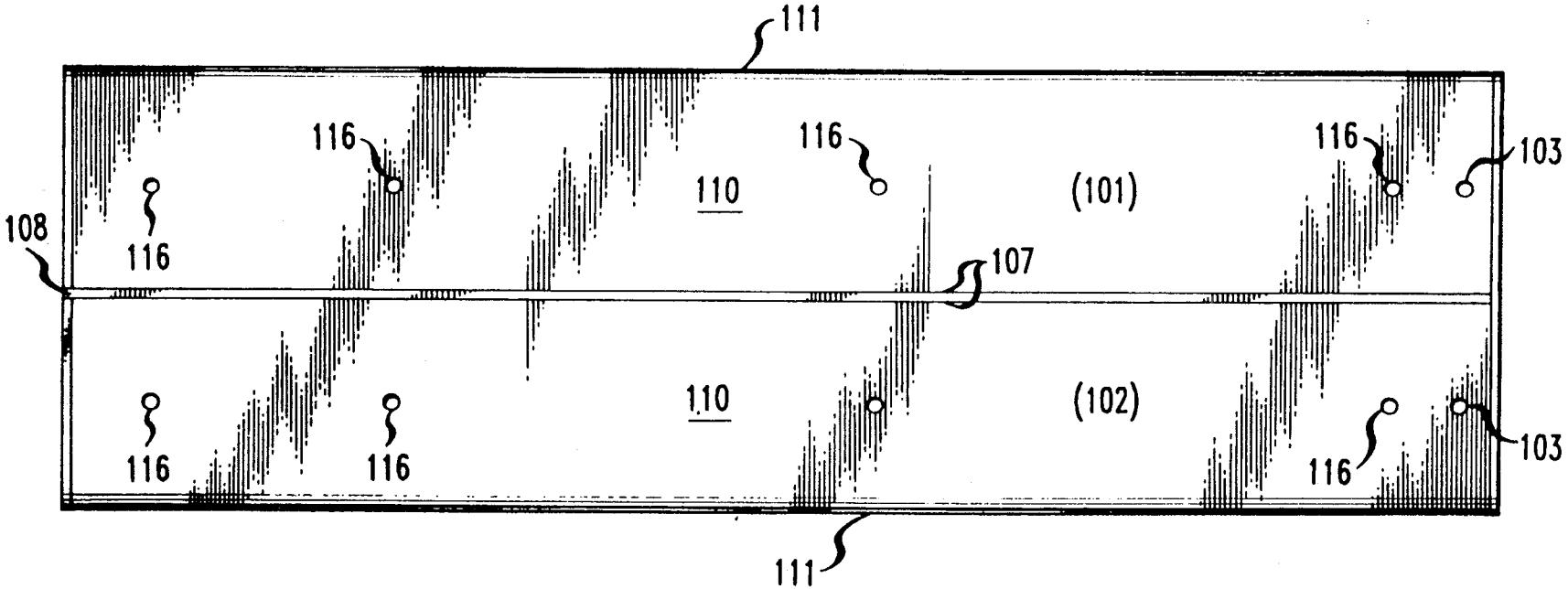
Figure 11:
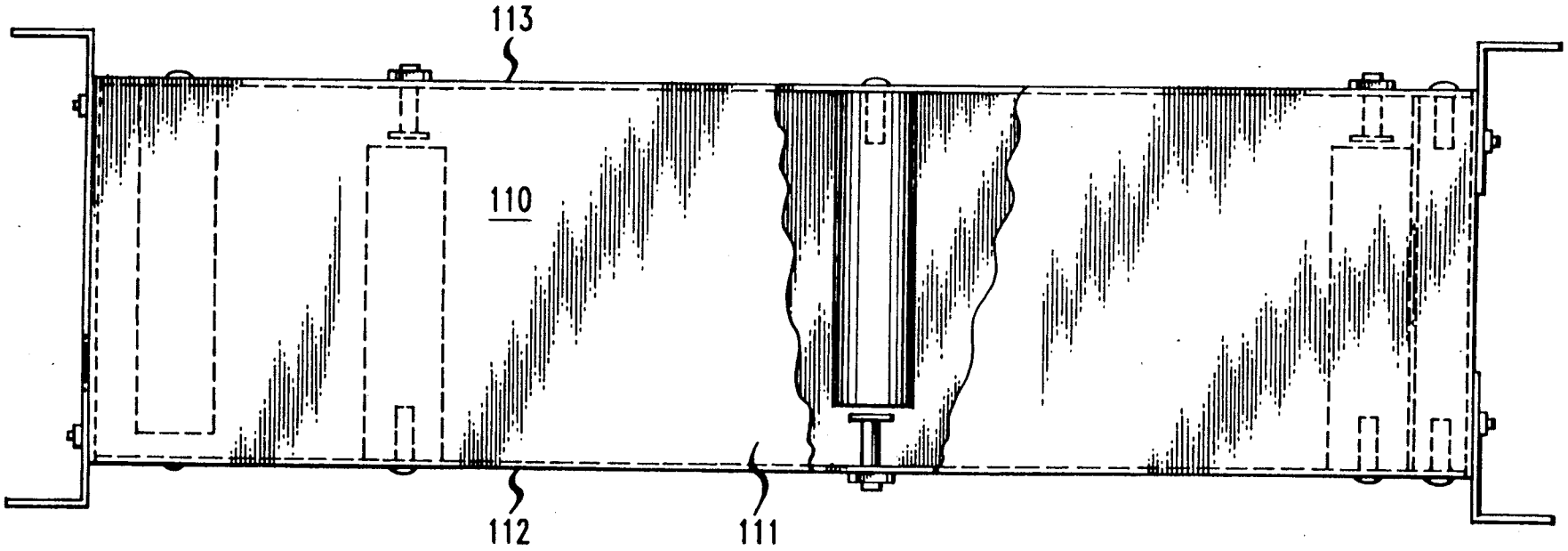
Figure 12:
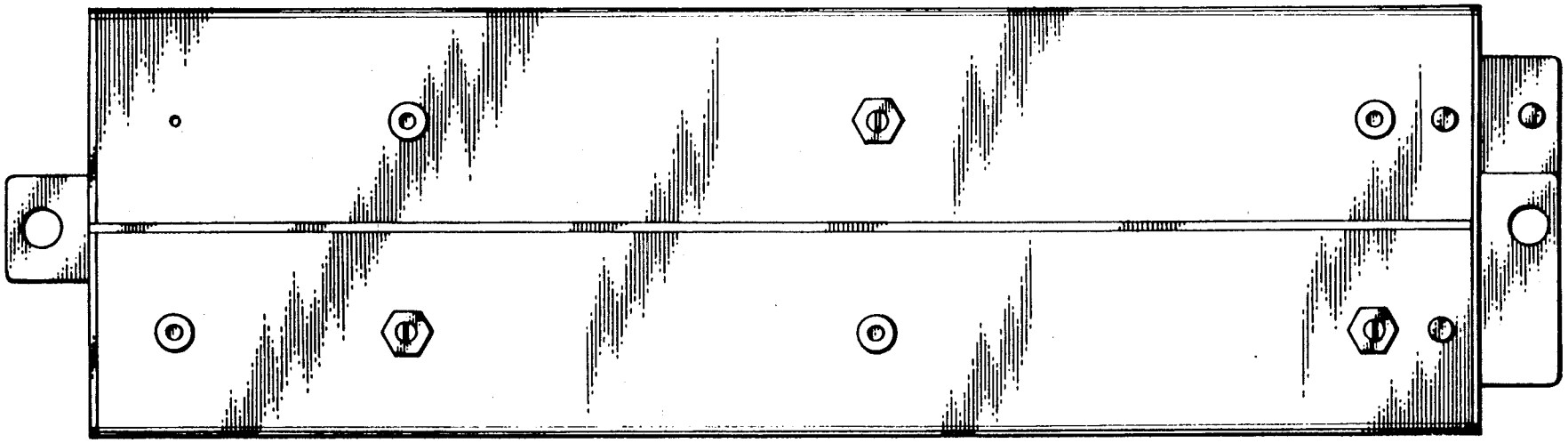

Orthogonal projections of the coupled line resonator cavity structure members are shown in FIGS. 10, 11 and 12. The channel shaped conductive member 110 has a substantially channel cross section consisting of the base 111 and two side walls 112 and 113. Two channel shaped conductive members are joined at their longitudinal edges 107 by welds to a planar conductive member 108 which divides the structure into two chambers 101 and 102. Tuning screws 103 are provided at the slot to adjust its electrical characteristics. Threaded apertures 116 are provided in the sidewalls for securing the transformer rods and the alternately interdigitized resonator rods and the associated tuning screws to the sidewalls. Tuning screws threaded into the sidewalls are provided opposite the rods for the purpose of electronically tuning them. The channel shaped conducting members 110 are constructed out of sheet invar pressed or stamped by compressive force into the desired channel shape. Other materials may be used, however, depending on the desired operating characteristics of the resonant cavity.

Figure 13:
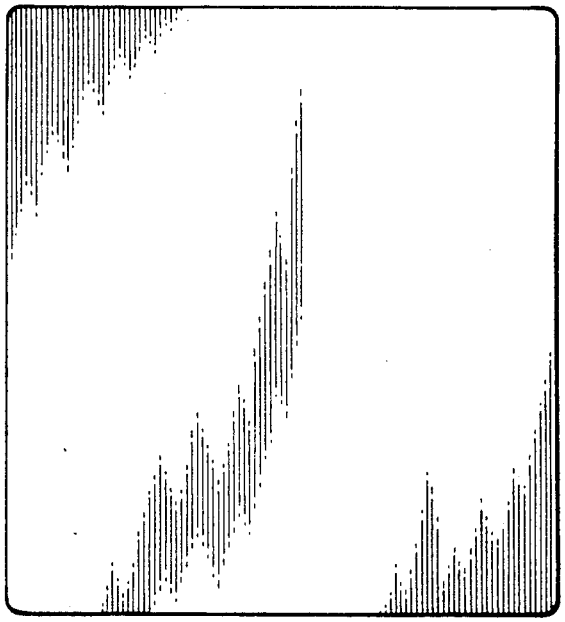

The end plate 141 attached at the folded end of the chamber is shown in FIG. 13 and is a flat plate of invar having a periphery conforming to the vertical cross section shape of the folded cavity structure. It is fastened to the end edges of the channel shaped conductive members by welds. The plate 141 is made of a conductive material such as sheet invar.

Figure 14:
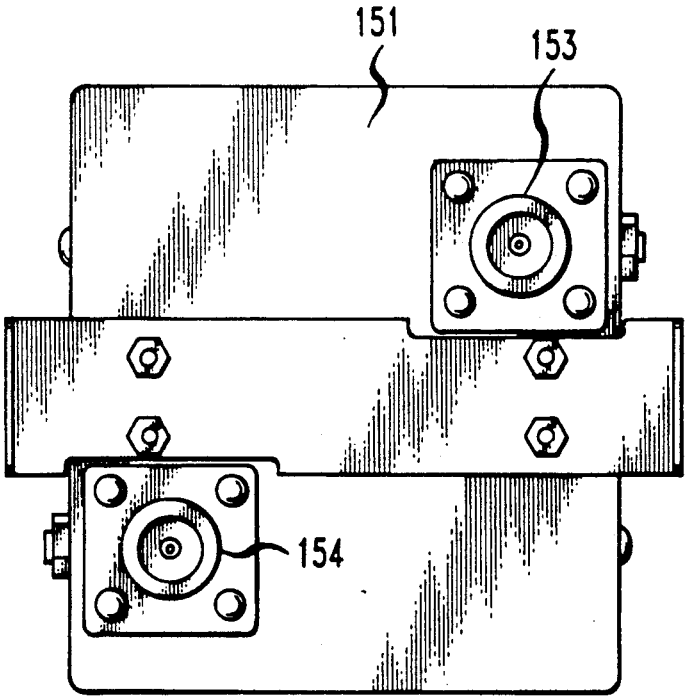
Figure 15:
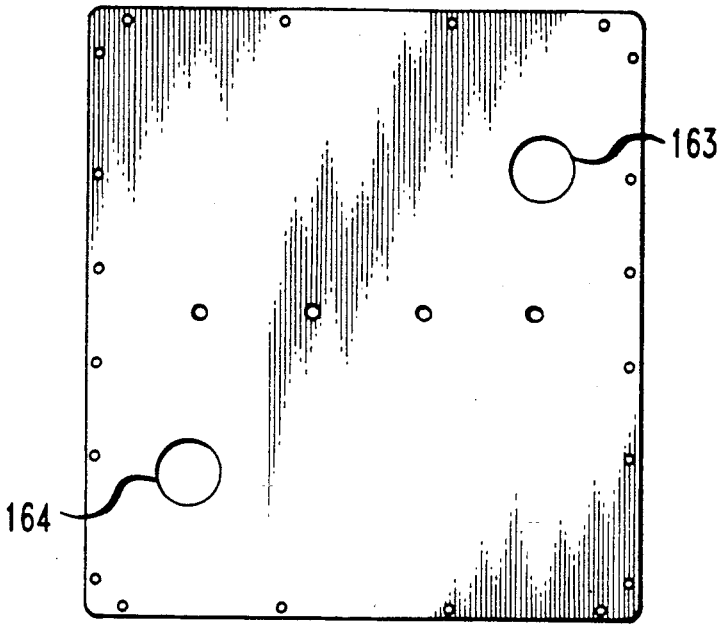

The opposite endplate 151 is shown in FIG. 14 and is fastened to the opposite end edges of the channel shaped conductive members by welds. Threaded apertures are provided for attachment and penetration of coaxial connectors 153 and 154 which apply and receive electrical energy to and from the chambers of the resonant cavity. This plate is also constructed of conductive sheet invar. The opposite endplate is also shown in FIG. 15 without the coaxial connectors which are inserted into the threaded apertures 163 and 164.

Figure 16:
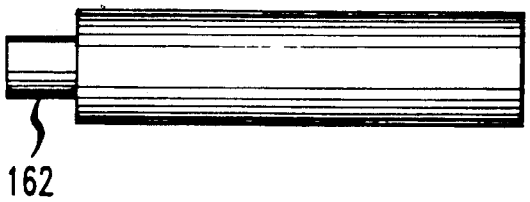
Figure 17:
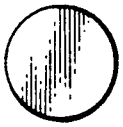

A plan and end view of the resonator rods 161 are shown in FIGS. 16 an 17. These rods are circular in cross section and include a threaded stud 162 at one end to facilitate attachment to the threaded holes in the side walls of the channel shaped conducting members. The transformer rods are similar in shape although differing in dimensions.

Figure 18:
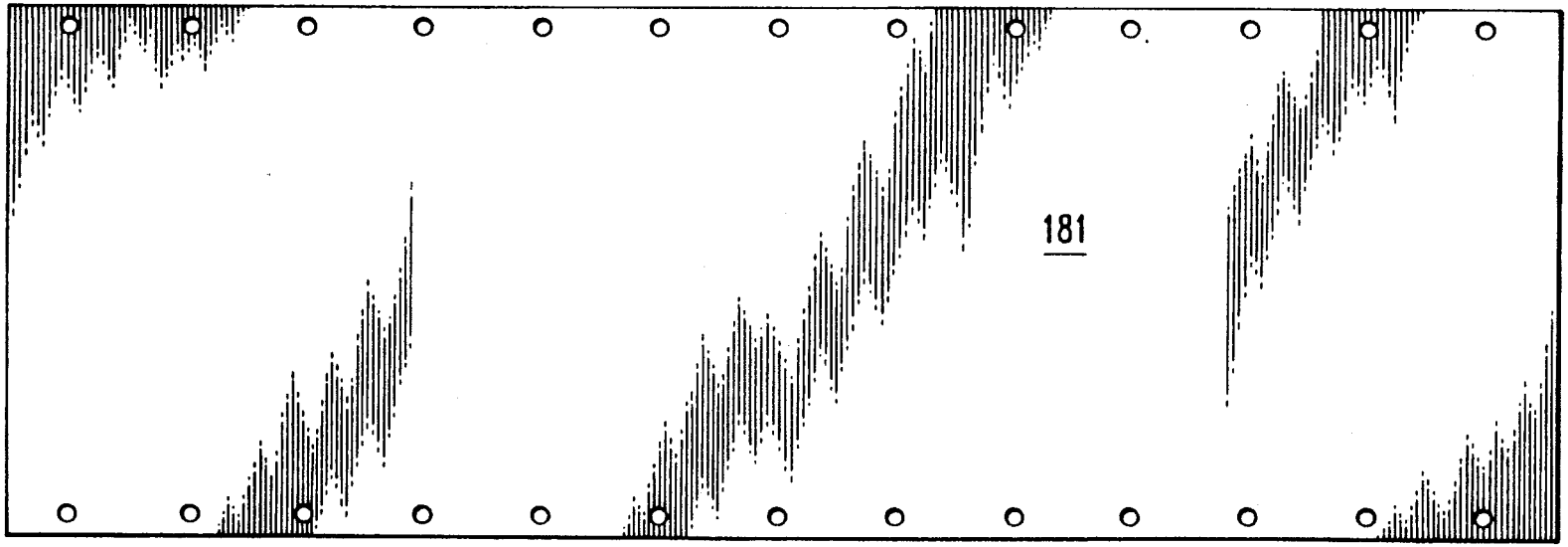

The common planar member 181 is shown in FIG. 18. It is secured to the longitudinal edges at the channel shaped conductive member by welds. Planar member 181 is constructed of sheet invar.

Figure 19:
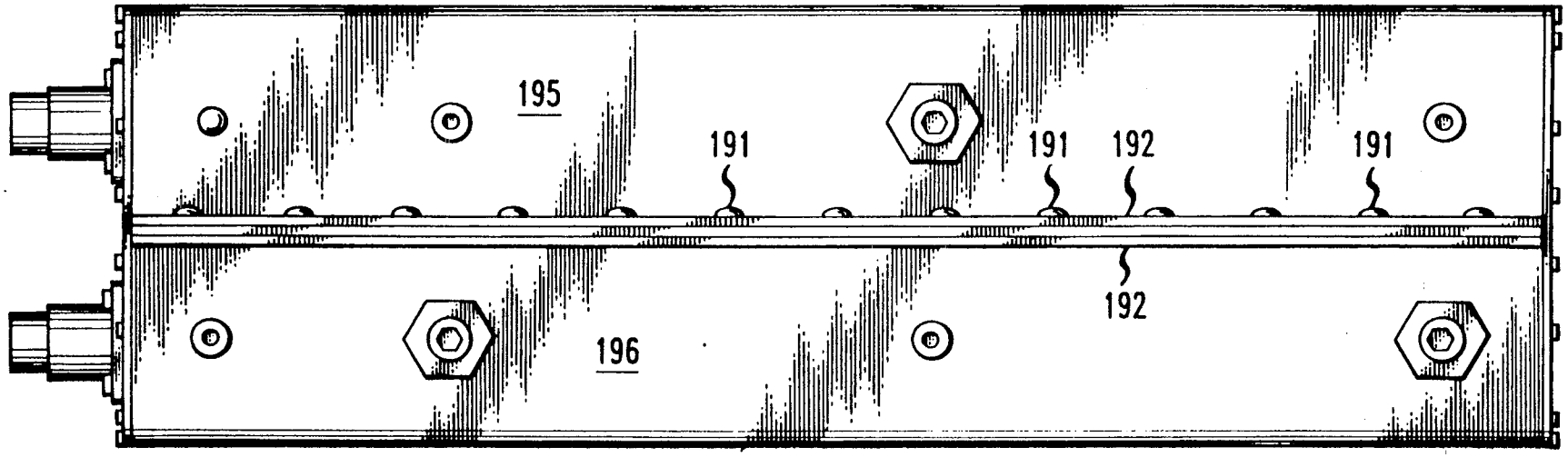
FIGS. 19, 20 are orthographic projections of another illustrative embodiment of the filter structure.
Figure 20:
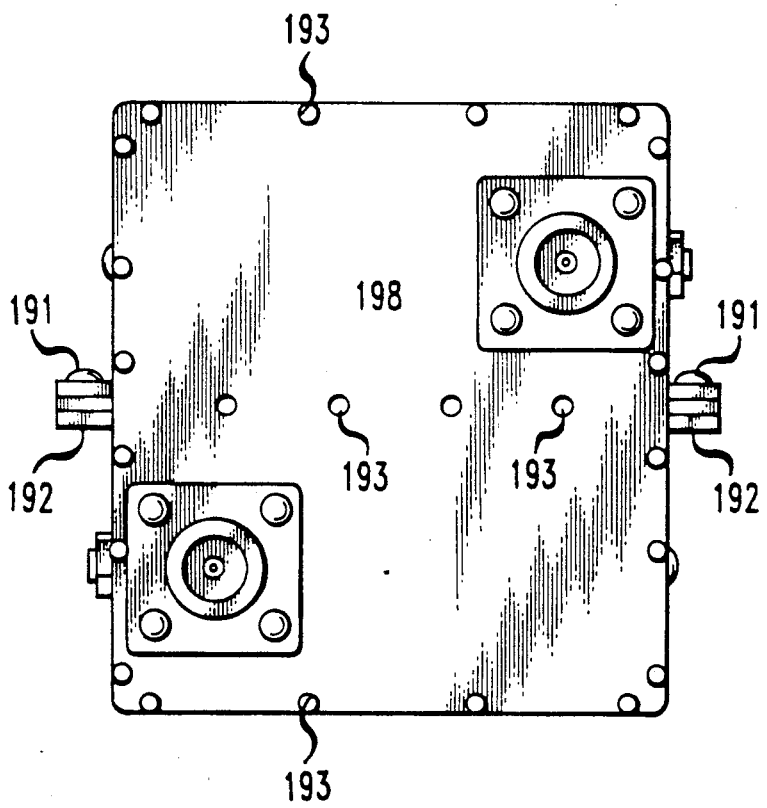

Another embodiment of the invention in which the component parts are secured together by threaded fasteners is shown in FIGS. 19 and 20. Flanges 192 are provided along the longitudinal edges of each of the channel members to provide a base for the inclusion of pairs of threaded and threadless apertures to accept threaded fasteners 191 to secure the two channel members 195 and 196 and the included common planar conductor 197 into one integral unit. The endplates 198 are secured to the ends of the channel members and the common planar conductor by the threaded fasteners 193.

The two preceding examples have disclosed a filter construction in which the structure is either joined by welded joints (FIGS. 6–13) or joined by threaded fastening devices (FIGS. 18–20). Construction may utilize a hybrid of these two methods of joining the components together. One suitable arrangement is utilizing channel members with flanges as shown in FIGS. 19 and 20 and joining the two channel members together with threaded fasteners as shown in FIGS. 19 and 20. The endplates would be fastened to the ends of the channel members by welding as shown in FIGS. 6 and 14. Various combinations of hybrid fastening may be used and devised by those skilled in the art without departing from the spirit and scope of the invention.

We claim:

1. A coupled line resonant cavity filter structure, comprising:

a first and second microwave chamber situated adjacent to one another, including;

a common planar conductive member between the first and second microwave chambers, and first and second conductive members each having a substantially channel cross section of stamped sheet metal with its longitudinal boundaries joined by welds to the common conductive planar member for defining outer conductive boundaries of the first and second microwave chambers;

first and second conductive endplates connected to opposing ends of the first and second conductive members of substantially channel cross section for enclosing the first and second microwave chambers;

the common planar conductive member being shorter than the outer conductive boundaries thereby leaving a slot between the common planar conductive member and the first conductive endplate so that the first and second microwave chambers are coupled together in a folded relation to each other to form a single resonant cavity;

each of the first and second microwave chambers including a plurality of resonator rods mounted on a sidewall of the first and second conductive members of substantially channel cross section, the resonator rods each having a length less than a distance between the opposite sidewalls of the first and second conductive members of substantially channel cross section;

the resonator rods being dimensioned to form with the common conductive planar member and the first and second conductive members of substantially channel cross section a filter unit operative to pass a microwave signal within a defined frequency band;

an input coaxial connector and an output coaxial connector each mounted on the second endplate, the input coaxial connector electrically interactive with the first microwave chamber for coupling microwave signal energy into the first microwave chamber and the output coaxial connector interactive with the second microwave chamber for receiving microwave signal energy from the second microwave chamber.

2. A coupled line resonant cavity filter structure as claimed in claim 1;

further including a mechanism for adjusting an electrical characteristic dimension of the slot.

3. A coupled line resonant cavity filter structure as claimed in claim 2;

further including first and second transformer rod in the first and second chambers and operative to electrically connect to the first and second coaxial connectors.

4. A coupled line band rejection filter structure, comprising;

a first and second microwave chamber situated adjacent to one another, including;

a common planar conductive member between the first and second microwave chamber, and first and second conductive members each having a substantially channel cross section of stamped sheet metal with flanges at the channel's longitudinal boundaries and connected with discrete fastener devices via the flanges to the common conductive planar member for defining outer conductive boundaries of the first and second microwave chambers;

first and second conductive endplates connected to opposing ends of the first and second conductive members of substantially channel cross section for enclosing the first and second microwave chambers;

the common planar conductive member being shorter than the outer conductive boundaries thereby leaving a slot between the common planar conductive member and the first conductive endplate so that the first and second microwave chambers are coupled together in a folded relation to each other to form a single coupled line resonant cavity;

tuning screws threaded into sidewalls of the first and second conductive members susbtantially adjacent the slot and operative for tuning the slot;

each of the first and second microwave chambers including a plurality of resonator rods mounted on a sidewall of the first and second conductive members of substantially channel cross section, the resonator rods each having a length less than a distance between the opposite sidewalls of the first and second conductive members of substantially channel cross section;

the resonator rods being dimensioned to form with the common conductive planar member and the first and second conductive members of substantially channel cross section a filter unit operative to pass a microwave signal within a defined frequency band;

an input coaxial connector and an output coaxial connector each mounted on the second endplate, the input coaxial connector electrically interactive with the first microwave resonant cavity for coupling microwave signal energy into the first microwave chamber and the output coaxial connector interactive with the second microwave chamber for receiving microwave signal energy from the second microwave chamber;

an impedance, matched to the characteristic impedance of the folded first and second microwave chambers, connected to the output coaxial connector;

a circulating device coupled to receive broadband signal energy and apply it to the input coaxial connector and supply output signal energy with a band of frequency of the defined frequency band within a bandpass characteristic of the folded first and second microwave chambers eliminated.

5. A microwave interdigital structure, comprising:

a first and second microwave chamber situated adjacent to one another, including;

a common planar conductive member between the first and second microwave chambers, and first and second conductive members each having a substantially channel cross section and connected to the common conductive planar member for defining outer conductive boundaries of the first and second microwave chambers;

first and second conductive endplates connected to opposing ends of the first and second conductive members of substantially channel cross section for enclosing the first and second microwave chambers;

the common planar conductive member being shorter than the outer conductive boundaries thereby leaving a slot between the common planar conductive member and the first conductive endplate so that the first and second microwave chambers are coupled together in a folded relation to each other to form a single microwave resonant cavity;

first and second threaded tuning devices inserted in a sidewall of at least one of the first and second conductive members substantially adjacent the slot and operative for adjusting an electrical characteristic of the slot;

each of the first and second microwave chambers including a plurality of interdigitized resonator rods alternately affixed to opposite sidewalls of the first and second conductive members of substantially channel cross section, the resonator rods each having a length less than a distance between the opposite sidewalls of the first and second conductive members of substantially channel cross section;

the interdigitized resonator rods being dimensioned to form with the common conductive planar member and the first and second conductive members of substantially channel cross section a filter substructure operative to pass a microwave signal within a defined frequency band;

an input coaxial connector and an output coaxial connector each mounted on the second endplate, the input coaxial connector electrically interactive cavity for coupling microwave signal energy into the first microwave chamber and the output coaxial connector interactive with the second microwave chamber for receiving microwave signal energy from the second microwave chamber;

a three port unidirectional signal path circulator having a first input port for accepting a cellular signal from an antenna, a second port connected to the first input coaxial connector, and a third port coupled to transmit a cellular signal to radio receiving equipment;

a terminating impedance equaling an impedance characteristic of the coupled line resonant cavity connected to the second coaxial connector for dissipating microwave signal energy from the microwave resonant cavity;

whereby the microwave interdigital filter structure operates as a notch filter of higher quality than an operative quality of the bandpass filter of the folded coupled line resonant cavity filter alone.

6. A coupled line filter structure, comprising:

a first and second microwave chamber situated adjacent to one another, including;

a common planar conductive member between the first and second microwave chambers, and first and second conductive members each having a substantially channel cross section and connected to the common conductive planar member for defining outer conductive boundaries of the first and second microwave chambers;

first and second conductive endplates connected to opposing ends of the first and second conductive members of substantially channel cross section for enclosing the first and second microwave chambers;

the common planar conductive member being shorter than the outer conductive boundaries thereby leaving a slot between the common planar conductive member and the first conductive endplate so that the first and second microwave chambers are coupled together in a folded relation to each other to form a single microwave resonant cavity;

tuning apparatus for adjusting an electrical characteristic of the slot;

each of the first and second microwave chambers including a plurality of resonator rods sidewalls of the first and second conductive members of substantially channel cross section, the resonator rods each having a length less than a distance between the opposite sidewalls of the first and second conductive members of substantially channel cross section;

the resonator rods being dimensioned to form with the common conductive planar member and the first and second conductive members of substantially channel cross section a filter substructure operative to pass a microwave signal within a defined frequency band;

an input coaxial connector and an output coaxial connector each mounted on the second endplate, the input coaxial connector electrically interactive with the microwave resonant cavity for coupling microwave signal energy into the first microwave chamber and the output coaxial connector interactive with the second microwave chamber for receiving microwave signal energy from the second microwave chamber;

a three port unidirectional signal path circulator having a first input port for accepting a cellular signal from an antenna, a second port connected to the first input coaxial connector, and a third port coupled to transmit a cellular signal to radio receiving equipment;

a terminating impedance equaling an impedance characteristic of the microwave resonant cavity connected to the second coaxial connector for dissipating microwave signal energy within a selected bandpass frequency band from the microwave resonant cavity;

whereby the microwave coupled line filter structure operates as a notch filter of higher quality than an operative quality of the bandpass filter of the folded microwave resonant cavity alone.

7. A microwave interdigital filter structure, comprising:

a first and second microwave chamber situated adjacent to one another, including;

a common planar conductive member between the first and second microwave chambers, and first and second conductive members each having a substantially channel cross section and connected to the common conductive planar member for defining outer conductive boundaries of the first and second microwave chambers;

first and second conductive endplates connected to opposing ends of the first and second conductive members of substantially channel cross section for enclosing the first and second microwave chambers;

the common planar conductive member being shorter than the outer conductive boundaries thereby leaving a slot between the common planar conductive member and the first conductive endplate so that the first and second microwave chambers are coupled together in a folded relation to each other to form a single microwave resonant cavity;

tuning apparatus for adjusting an electrical characteristic of the slot;

each of the first and second microwave chambers including a plurality of interdigitized resonator rods alternately affixed to opposite sidewalls of the first and second conductive members of substantially channel cross section, the resonator rods each having a length less than a distance between the opposite sidewalls of the first and second conductive members of substantially channel cross section;

the interdigitized resonator rods being dimensioned to form with the common conductive planar member and the first and second conductive members of substantially channel cross section a filter substructure operative to pass a microwave signal within a defined frequency band;

an input coaxial connector and an output coaxial connector each mounted on the second endplate, the input coaxial connector electrically interactive with a resonator rod in the first microwave resonant cavity for coupling microwave signal energy into the first microwave chamber and the output coaxial connector interactive with a resonator rod in the second microwave chamber for coupling microwave signal energy into the second microwave chamber;

a three port unidirectional signal path circulator having a first input port for accepting a cellular signal from an antenna, a second port connected to the first input coaxial connector, and a third port coupled to transmit a cellular signal to radio receiving equipment;

a terminating impedance equaling an impedance characteristic of the microwave resonant cavity connected to the second coaxial connector for dissipating microwave signal energy from the microwave resonant cavity within a defined bandpass frequency;

whereby the microwave interdigital filter structure operates as a notch filter of higher quality than an operative quality of the bandpass filter of the folded microwave resonant cavity alone.

8. A microwave interdigital filter structure, comprising:

a first and second microwave chamber situated adjacent to one another, including;

a common planar conductive member between the first and second microwave chambers, and first and second conductive members each having a substantially channel cross section and connected to the common conductive planar member for defining outer conductive boundaries of the first and second microwave chambers;

first and second conductive endplates connected to opposing ends of the first and second conductive members of substantially channel cross section for enclosing the first and second microwave chambers;

the common planar conductive member being shorter than the outer conductive boundaries thereby leaving a slot between the common planar conductive member and the first conductive endplate so that the first and second microwave chambers are in a folded relation to each other and form a single microwave resonant cavity;

first and second adjustable tuning screws inserted in a sidewall of the first and second chambers adjacent the slot and operative for adjusting an electrical characteristic of the slot;

each of the first and second microwave chambers including a plurality of interdigitized resonator rods alternately affixed to opposite sidewalls of the first and second conductive members of substantially channel cross section, and at least a transformer rod adjacent to the second endplate in each of the first and second microwave chambers, the resonator rods and the transformer rods each having a length less than a distance between the opposite sidewalls of the first and second conductive members of substantially channel cross section;

the interdigitized resonator rods and transformer rods being dimensioned to form with the common conductive planar member and the first and second conductive members of substantially channel cross section a filter substructure operative to pass a microwave signal within a defined frequency band;

an input coaxial connector and an output coaxial connector each mounted on the second endplate, the input coaxial connector electrically interactive with the transformer rod in the first microwave chamber for coupling microwave signal energy into the first microwave chamber and the output coaxial connector interactive with the transformer rod in the second microwave chamber for coupling microwave signal energy into the second microwave chamber;

a three port unidirectional signal path circulator having a first input port for accepting a cellular signal from an antenna, a second port connected to the first input coaxial connector, and a third port coupled to transmit a cellular signal to radio receiving equipment;

a terminating impedance equaling an impedance characteristic of the microwave resonant cavity connected to the second coaxial connector for dissipating microwave signal energy from the microwave resonant cavity;

whereby the microwave interdigital filter structure operates as a notch filter of higher quality than an operative quality of the bandpass filter of the folded microwave resonant cavity alone.

9. A microwave interdigital filter structure as claimed in claim 8, further comprising:

longitudinal edges of the first and second outer boundaries of conductive material are joined to the common planar conductive member by welds to form the first and second microwave chambers.

10. A microwave interdigital filter structure as claimed in claim 8, further comprising:

each of the first and second outer boundaries of conductive material has a first and second flange on opposite sides of the channel, and the common planar conductive member is clamped between the first and second flanges of each of the outer boundaries of conductive material with threaded fastening devices.

11. A microwave interdigital filter structure as claimed in claim 8, further comprising:

the conductive outer boundaries, endplates and common planar conductive member are all constructed of invar.

12. A microwave interdigital filter structure as claimed in claim 8, further comprising:

the endplates are connected to the conductive outer boundaries by screw type fastening devices.

13. A microwave interdigital filter structure as claimed in claim 8, further comprising:

the endplates are connected to the conductive outer boundaries by weld connections.

14. A resonant cavity band rejection filter, comprising:

a first channel member with a flange along each longitudinal edge of the channel formed by compressively molding a sheet of invar sheet material;

a second channel member with a flange along each longitudinal edge of the channel formed by compressively molding a sheet of invar sheet material;

the first and second channel members having substantially identical longitudinal, width and depth dimensions;

a planar divider of invar sheet material having a width substantially equaling the width of the first and second second channel members and shorter in longitudinal dimension than the longitudinal dimension of the first and second channel members;

the first and second channel members and the planar divider fastened into one integral unit with threaded fasteners passing through the flanges and periphery of the planar divider so that one end of the planar divider is coincident with end boundaries of the first and second channel members and an end of the planar divider opposite the one end terminates short of the end boundary of the first and second channel member and thereby forming first and second cavities;

a plurality of resonator rods fastened with threaded fasteners to first and second channel members in each of the first and second channel members with adjacent resonator rods being fastened to opposite sidewalls and each resonator having a threaded tuning devices inserted into a sidewall opposite the sidewall to which the resonator rod is affixed;

a first endplate attached to end boundaries of the first and second channel members and the one end of the planar divider with threaded fastening devices, the first end plate having first and second coaxial connectors threaded into threaded receptacles of the first end plate for engaging the first and second cavities and enabling electrical connection with the first and second cavities formed by the first and second channel members and planar divider;

a second end plate attached with threaded fasteners to end boundaries of the first and second channel members opposite the end boundaries to which the first end plate is attached;

an impedance connected to the first coaxial connector for terminating the cavity with its characteristic impedance;

a three port circulator having its middle port attached to the second coaxial connector; an initial port of the circulator accepting input signals to the band rejection filter and the end port of the circulator supplying output signals from the band rejection filter.

15. A coupled line resonant cavity filter structure, comprising:

a first and second microwave chamber situated adjacent to one another, including:

a common planar conductive member between the first and second microwave chambers, and first and second conductive members each having a substantialy channel cross section of stamped sheet metal;

the conductive members joined together at the channel's longitudinal boundaries by welding connections to the conductive planar member for defining outer conductive boundaries of the first and second microwave chambers;

first and second conductive endplates welded to opposing ends of the first and second conductive members of substantially channel cross section for enclosing the first and second microwave chambers;

the common planar conductive member being shorter than the outer conductive boundaries thereby leaving a slot between the common planar conductive member and the first conductive endplate so that the first and second microwave chambers are coupled together in a folded relation to each other to form a single resonant cavity;

each of the first and second microwave chambers including a plurality of resonator rods mounted on a sidewall of the first and second conductive members of substantially channel cross section, the resonator rods each having a length less than a distance between the opposite sidewalls of the first and second conductive members of substantially channel cross section;

the resonator rods being dimensioned to form with the common conductive planar member and the first and second conductive members of substantially channel cross section a filter unit operative to pass a microwave signal within a defined frequency band;

an input coaxial connector and an output coaxial connector each mounted on the second endplate, the input coaxial connector electrically interactive with the first microwave chamber for coupling microwave signal energy into the first microwave chamber and the output coaxial connector interactive with the second microwave chamber for receiving microwave signal energy from the second microwave chamber.

16. A coupled line resonant cavity filter structure as claimed in claim 15, further including a mechanism for adjusting an electrical characteristic of the slot.

17. A coupled line resonant cavity filter structure as claimed in claim 16, further including first and second transformer rods in the first and second microwave chambers and operative to electrically connect to the first and second coaxial connectors.

* * * * *